United States Patent [19]

Kauss

[11] Patent Number: 4,606,258

[45] Date of Patent: Aug. 19, 1986

[54] SELF-PRESSURIZING HYDRAULIC CONTROL SYSTEM

[75] Inventor: Wolfgang Kauss, Lohr-Wombach, Fed. Rep. of Germany

[73] Assignee: Manneshann Rexroth GmbH, Lohr, Fed. Rep. of Germany

[21] Appl. No.: 670,312

[22] Filed: Nov. 13, 1984

[30] Foreign Application Priority Data

Nov. 10, 1983 [DE] Fed. Rep. of Germany ..... 3340676

[51] Int. Cl.[4] ..... F15B 13/042

[52] U.S. Cl. ..... 91/433; 91/461

[58] Field of Search ..... 91/433, 461

[56] References Cited

FOREIGN PATENT DOCUMENTS 8206979 3/1982 Fed. Rep. of Germany .

3106086 9/1982 Fed. Rep. of Germany .

*Primary Examiner*—Gerald A. Michalsky

*Attorney, Agent, or Firm*—Andrew Wilford

[57] ABSTRACT

A hydraulic system for operating a pressurizable load off a pressure source having a high-pressure side and a low-pressure side has a main valve having a load side connected to the load and a source side connected to both sides of the source and displaceable between one position permitting flow from the source to the load and another position for opposite flow. Respective fluid-operated actuators displace the valve into its positions. A controller has an input side connected to the high-pressure sides of the source at the source side of the valve and an output side connected to the load at the load-side of the valve and with the sump at the source side of the valve. This controller also is connected to the actuators for pressurizing same alternately and thereby moving the valve between its positions. A pressurizing unit is connected at least to the source side of the pump and to both sides of the valve and of the controller for maintaining a generally constant pressure drop across the valve and the controller.

12 Claims, 6 Drawing Figures

SELF-PRESSURIZING HYDRAULIC CONTROL SYSTEM

FIELD OF THE INVENTION

The present invention relates to a fluid-powered control system. More particularly this invention concerns a hydraulic control system which uses fluid pressure to pressurize and operate itself.

BACKGROUND OF THE INVENTION

It is standard to operate a load, for instance a double-acting hydraulic cylinder, off a source, for instance a pump and a sump or reservoir, by means of a valve that itself is powered hydraulically. Such an arrangement, however, requires that a separate fluid-pressure source be provided to operate the actuators for the valve since the entire system is depressurized when the load is also depressurized.

OBJECTS OF THE INVENTION

It is therefore an object of the present invention to provide an improved hydraulic control system.

Another object is the provision of such a hydraulic control system which overcomes the above-given disadvantages, that is which does not need a separate control-pressure source, but that instead can work off the pressure it is employing to operate the load.

SUMMARY OF THE INVENTION

A hydraulic system for operating a pressurizable load off a pressure source having a high-pressure side and a low-pressure side according to the invention has a main valve having a load side connected to the load and a source side connected to both sides of the source and displaceable between one position permitting flow from the source to the load and another position for opposite flow. Respective fluid-operated actuators displace the valve into its positions. A controller has an input side connected to the high-pressure side of the source at the source side of the valve and an output side connected to the load at the load-side of the valve and with the sump at the source side of the valve. This controller also is connected to the actuators for pressurizing same alternately and thereby moving the valve between its positions. A differential-pressure regulator or pressurizing unit is connected at least to the source side of the pump and to both sides of the valve and of the controller for maintaining a generally constant pressure drop across the valve and the controller.

Thus with the system of this invention under all circumstances some pressure head is maintained for exploitation by the controller as its control pressure, eliminating the need for a separate pump. Even when neither actuator is pressurized so that the load is stationary, this head is maintained, unlike prior-art systems where the entire system is be under the same pressure or wholly depressurized, so that at any time the system's own pressure can be used to operate the actuators. In a normal arrangement the output side of the controller is connected to the load so that pressure is not wasted, but is fed to the load for use there.

According to another feature of this invention the differential-pressure regulator is connected across the sides of the control valve and to the sump. This regulator can be of the differential type that blocks flow from the high-pressure side of the source to the valve when pressure at the load side of the valve is higher than a predetermined level below the pressure at the high-pressure side of the source. It can also bleed pressure from the high-pressure side to the low-pressure side when pressure at the load side of the valve is higher than a predetermined level below the pressure at the high-pressure side of the source. The system can have a snap valve connected on one side to the regulating valve and on its other side to the load side of the main valve and connectable therethrough to the high- and low-pressure sides of the source.

In accordance with another feature of the invention a flow control valve is connected between the actuators for blocking flow therebetween when closed and permitting flow therebetween when open.

It is possible according to this invention to use a half-wave controller having two restrictions both connected from the high-pressure side of the source at the source side of the valve to the respective actuators. A full wave arrangement has two more such restrictions connected between the load-side of the valve, which as mentioned above is maintained a predetermined pressure below the high-pressure side at the source side of the valve, and the respective actuators. Either way at least one of these actuators is variable, and for fastest operation two are ganged together so that an increase in flow cross section of the one is automatically coupled with a decrease in flow section of the other.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
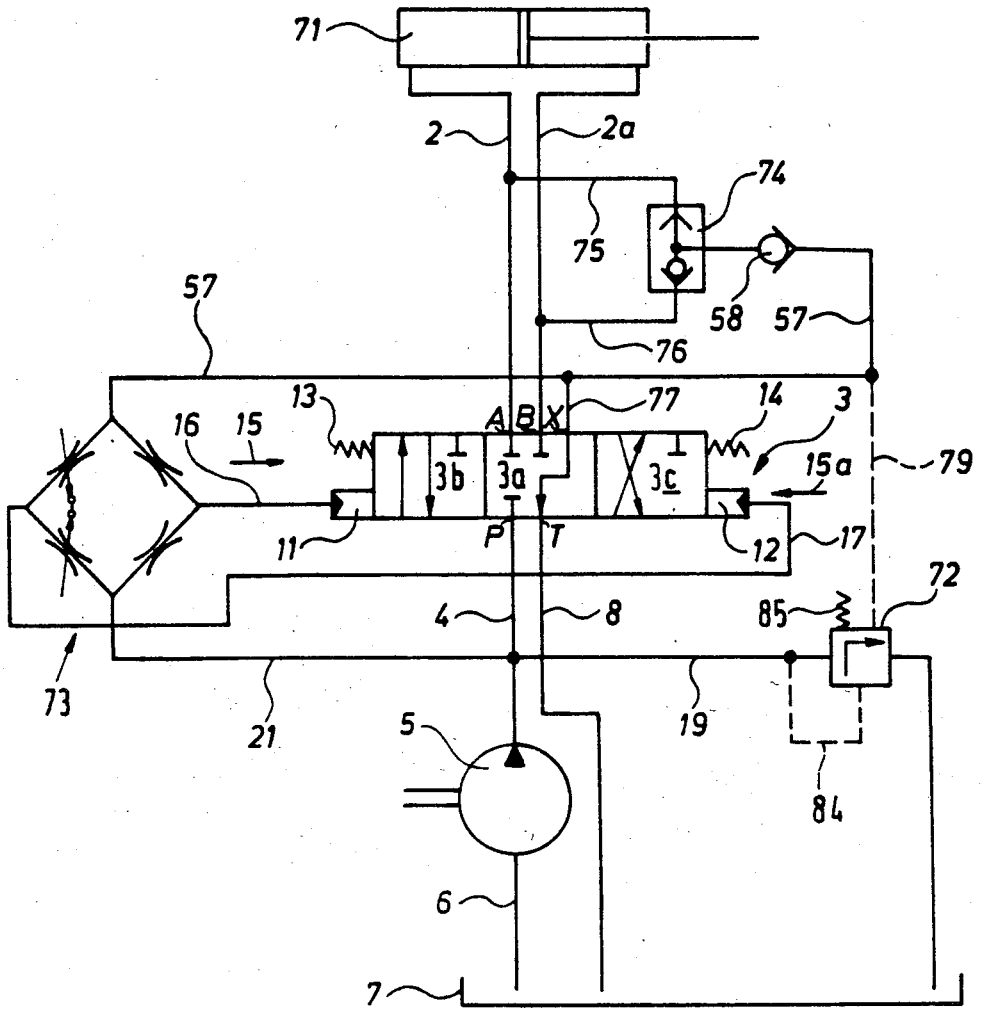
FIG. 1 is a diagrammatic view of a system according to the invention.

As seen in FIG. 1 a pump 5 has a high-pressure side connected to a high-pressure line or conduit 4 and a low-pressure side connected via a line or conduit 6 to a sump 7. A line 19 connected to the high-pressure line 4 is connected to a differential-pressure regulator 72 connected to the sump 7 to control pressure in the system. This regulator 72 has a pair of opposite pilot lines 79 and 84, the latter of which is connected back to the line 19. It is biased by a spring 85 into the closed position against the pressure in the line 19, but when open bleeds pressure from the line 4 into the sump 7.

A proportional-type slide valve 3 has three parts 3*a*, 3*b*, and 3*c*, a high-pressure port P and a low-pressure port T on one side, and three other ports A, B, and X on its opposite side. The ports A and B are connected via respective lines 2 and 2*a* to the back and front compartments of a double-acting actuating ram 71 here constituting the controlled load. Respective actuators 11 and 12 operable by fluid pressure in respective lines 16 and 17 can push the valve 3 in respective directions 15 and 15*a*. Springs 13 and 14 normally urge the valve 3 into the illustrated position, with its center part 3*a* between the ports A, B, X on one side and P and T on the other.

The high-pressure line 4 of the pump 5 is connected via a line 21 to an electrical or electronic controller 73 also connected via a control line 57 and a check valve 58 to a changeover valve 74 whose two ports are connected via respective lines 75 and 76 to the back-compartment and front-compartment actuator lines 2 and 2*a*. This valve 74 prevents flow in either direction between the lines 75 and 76, but permits flow from the control line 57 into whichever of the lines 75 or 76 is at a pressure higher than that of the other respective line 76 or 75 but lower than that of the line 57. Another line 77 connects the control line 57 to the port X.

The controller 73 can be constituted as a hydraulic bridge in each of whose legs there is a restriction. At least two of these restrictions are variable, normally by means of some servomotor mechanism, and preferably they are connected together so that as one is made smaller, the other is made larger. This controller 73 is connected to and operates the two lines 16 and 17 of the actuators 11 and 12 in accordance with orders fed to it electrically, thereby changing the flow cross section of one or the other or even both of the variable restrictions. Obviously, to do this it is essential that the controller 73 dispose of a pressure head sufficient to operate the two normally hydraulic single-acting cylinders 11 and 12. As will be described below, according to the present invention it is altogether common to operate both of the actuators 11 and 12 under high pressure, and is even theoretically possible to operate all or part of the system pneumatically under vacuum, so long as a sufficient pressure difference exists between the pressure in the two actuators 11 and 13.

The differential-pressure regulator 72 is connected via the pilot line 79 to the control line 57 so that the pressure in the lines 4 and 21 is controlled by the pressure in this control line 57. When the load-side pressure increases so the force effective from the source-side pressure through the pilot line 84 from the line 19 is exceeded by the sum of the force of the spring 85 and the load-side pressure coming via the pilot line 79 to the opposite side of the valve body of the regulator 72, the regulator 72 will close and allow pressure to build up in the lines 4, 19, and 21. Similarly when the pressure in the line 57 drops relative to the pressure in the lines 4, 19, and 21, the regulator 72 will open slightly, decreasing the source-side pressure. This action therefore maintains a constant pressure differential between the lines 57 and 21, regardless of the position of the valve 3, with the pressure in the line 21 always exceeding that in the line 57 by a predetermined differential primarily determined by the force of the spring 85.

In the rest position illustrated in FIG. 1 the valve part 3*a* disconnects the ports A, B, and P from any direct contact with each other, and connects the port X through the port T and line 8 to the sump 7. The actuator 71 will therefore hold in whatever position it is in. Furthermore, in this position the control line 57 is connected via the line 77 and through the ports X and T to the sump 7 so that this line 57 is wholly depressurized and the regulator 72 bleeds pressure from the high-pressure lines 4, 19, and 21 to keep pressure therein at a relatively low level that is nonetheless sufficient to operate the actuators 11 and 12.

When the actuator 11 is pressurized to move the valve into the right-hand position with the part 3*b* between the ports A, B, X, P, and T, the full pressure of the pump 5 will be applied from the port P through to the port A and thence via the line 2 to the back compartment of the double-acting ram 71. The front compartment of the ram 71 will be connected via the line 2*a* and the ports B and T to the line 8 for the sump 7. This will urge the piston of the ram 71 to the right until it comes to the end of the cylinder or meets a resisting force greater than the rightward pushing force. In addition in this position the control line 57, which as described above is at a pressure that is somewhat less than the pressure in the lines 2 and 4, is connected via the open check valve 58 to the switchover valve 74 which in turn is connected via the line 75 with the high-pressure line 2. The differential-pressure regulator 72 maintains the pressure differential between the ports P and A of the valve 3 constant.

Similarly, when the actuator 12 is pressurized to move the valve into the left-hand position with the part 3*c* between the ports A, B, X, P, and T, the full pressure of the pump 5 will be applied from the port P through to the port B and thence via the line 2*a* to the front compartment of the double-acting ram 71. The back compartment will be connected via the line 2 and the ports A and T to the line 8 for the sump 7, to urge the piston of the ram 71 leftward. In addition in this position the control line 57 is connected via the open check valve 78 to the switchover valve 74 which in turn is connected via the line 76 with the high-pressure line 2*a*. The differential-pressure regulator 72 maintains the pressure differential between the ports P and B of the valve 3 constant.

Figure 2:
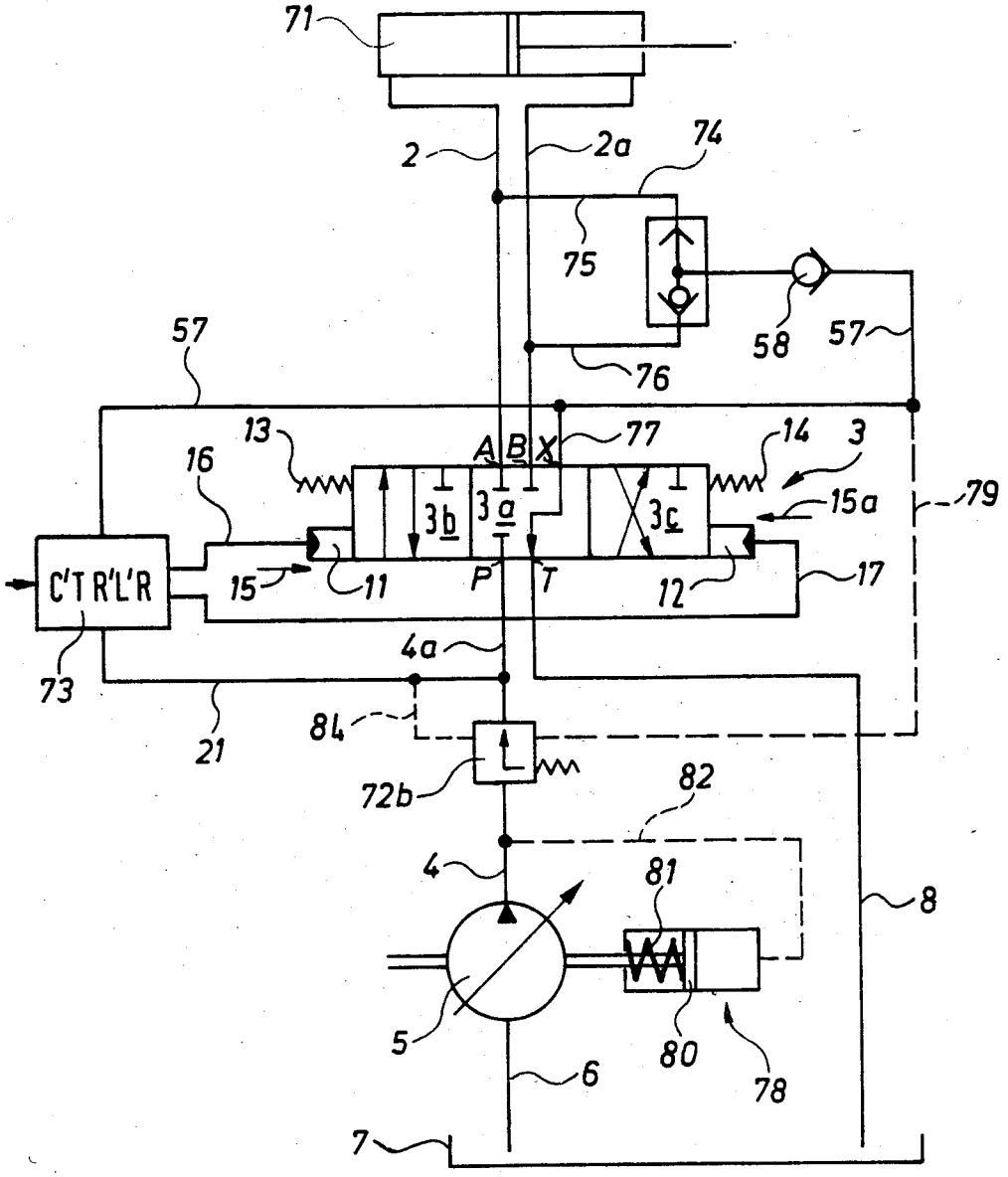
FIGS. 2 and 3 are diagrams of variations on the system of FIG. 1.
Figure 3:
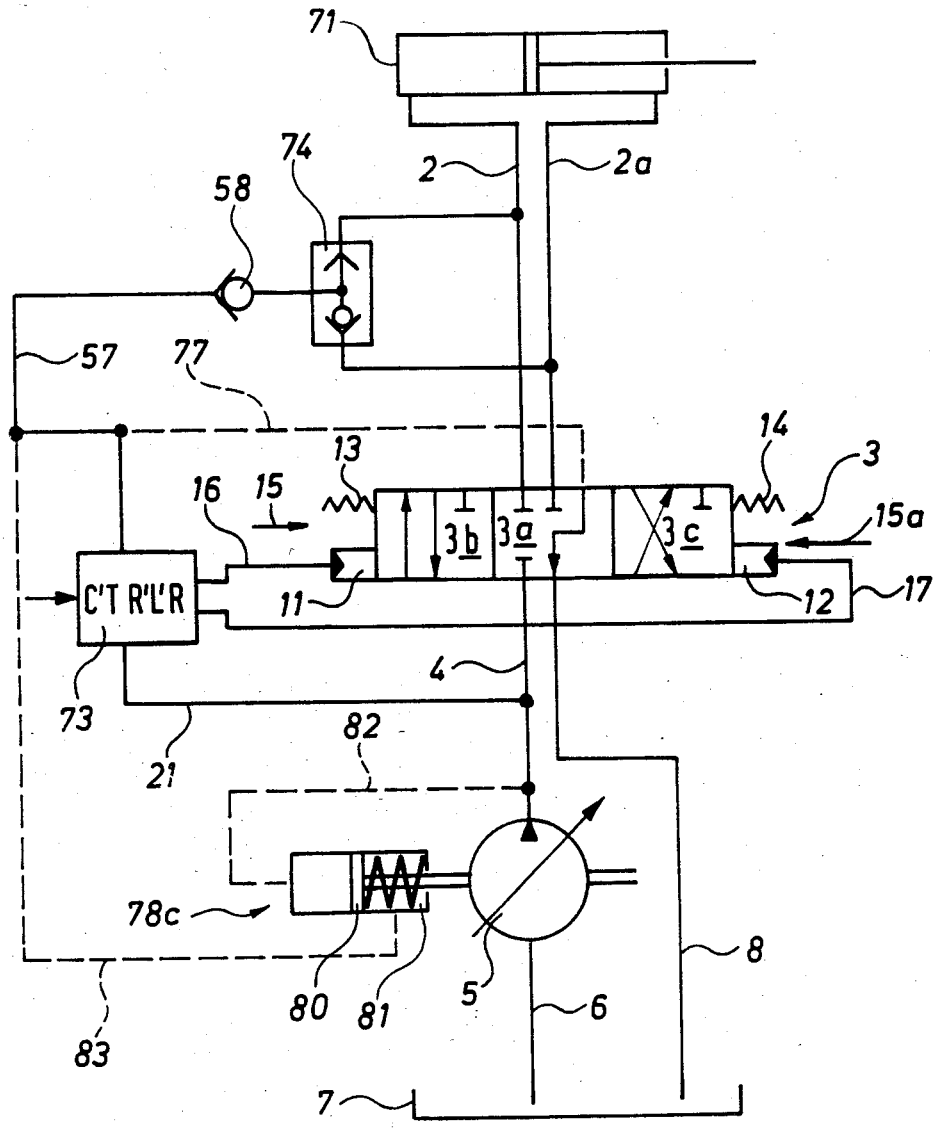

The arrangements of FIGS. 2 and 3 differ from that of FIG. 1 in that the source-side pressure is limited by using a variable-displacement pumps 5', for example of the axial-piston type, and by varying the displacement, instead of by bleeding excess pressure back to the sump 7.

Thus in FIG. 2 a regulator 72*b* identical to the regulator 72 is provided right in the main high-pressure line 4, cutting off a downstream portion 4*a* from which the pilot line 84 extends. Flow from the variable-displacement pump 5' is therefore limited when the pressure in lines 21 and 4*a* exceeds that in the line 57 by more than a predetermined difference.

In addition an automatic regulating device 78 is provided connected to the swash plate or other control element of the pump 5'. This device comprises a piston 80 and a cylinder. A pilot line 82 applies the pressure from the line 4 to one face of the piston, and a spring 81 bears against the other. Thus the pressure in the line 4 between the pump 5' and regulator 72*b* is limited to a certain absolute maximum.

In FIG. 3 a pump regulator 78*c* of construction substantially identical to that of the unit 78 of FIG. 2 is used, but the front or rod compartment is pressurized via a pilot line 83 extending from the control line 57. Thus this regulator 78*c* varies the pump displacement to increase pressure in the line 4 whenever this pressure falls too low relative to the pressure in the line 57.

Figure 4:
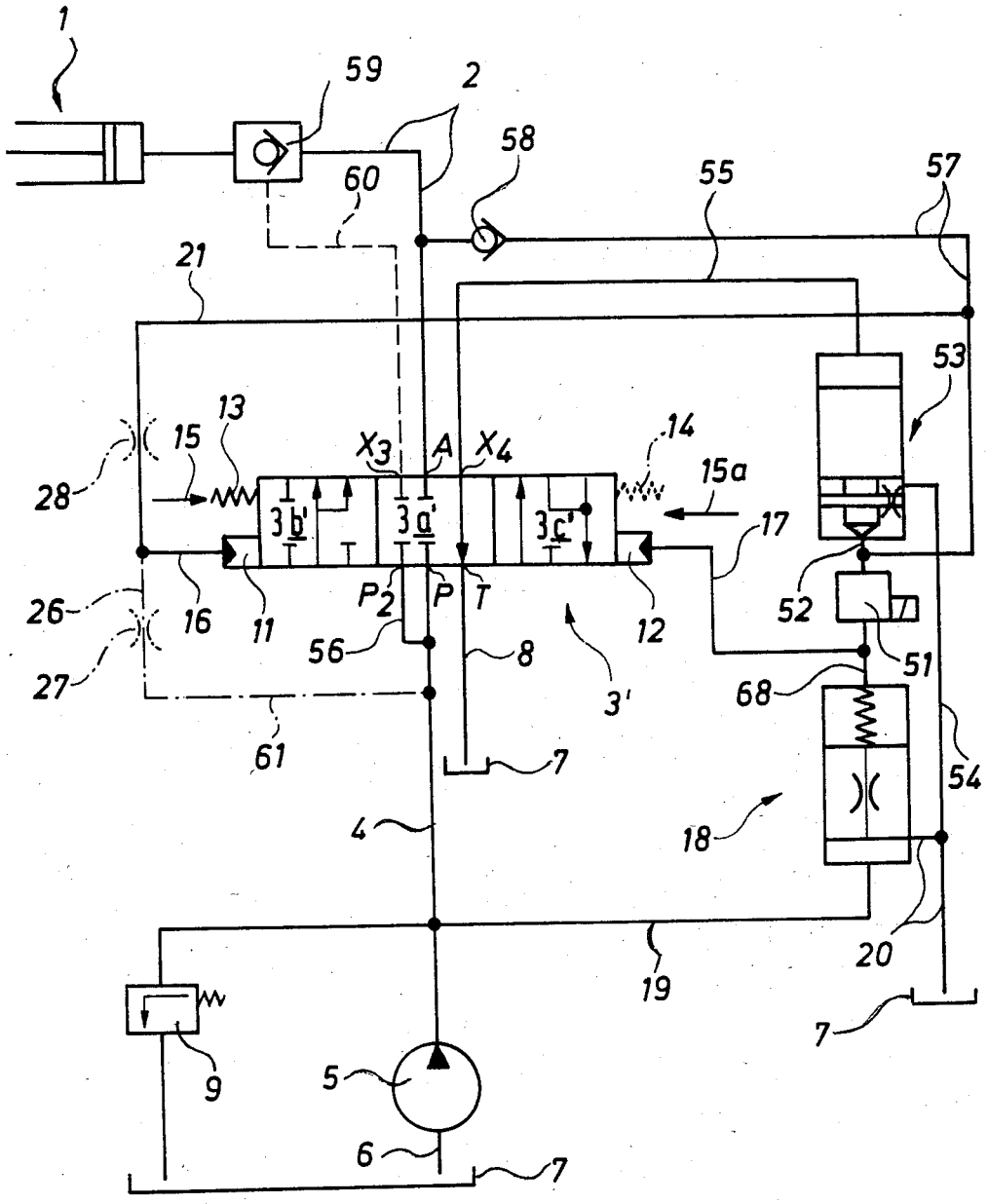
FIG. 4 is a diagrammatic view of another system according to this invention.

The system of FIG. 4 has a valve 3' with three parts 3*a'*, 3*b'*, and 3*c'* defining respective positions and six ports A, $X_3$, $X_4$, P, $P_2$, and T. As in FIGS. 1 through 3, ports P, A, and T are respectively connected to the lines 4, 2, and 8. In addition the port $P_2$ is also connected by a short conduit or line 56 to the line 4, in which pressure is limited by a standard pressure-relief valve 9 connected to the sump 7.

A pressure compensator 18 has one side connected via a line 19 to the line 4 and an opposite side connected via a line 68 and a solenoid-operated flow-control valve 51 to an input line 52 of a snap-type valve 53 of the type described in German utility model No. 8,206,979. A controllable differential-pressure regulator could replace the valve 51. The feed line 17 for the actuator 12 is connected to the line 68 between the valves 18 and 41. The back chamber of the valve 53 is connected via a line 55 to the port $X_4$. Both the valve 53 and the pressure compensator 18 are connected via respective lines 20 to the sump 7 so that the valve 53 will be depressurized behind its thin piston, here formed with a restriction, and when the piston of the compensator 18 moves past the port at which the line 20 opens into the valve 18 it will be depressurized. The piston of the pressure compensator 18 also formed, as is standard, with a small-diameter bleed passage or pore.

The control line 57 is connected to the line 52 between the valves 51 and 53. The line 2 is connected here via an openable check valve 59 to a single-acting load, here a fluid-powered cylinder. A pilot line 60 which if pressurized opens the valve 59 to bidirectional flow is connected from this valve 59 back to the port $X_3$. Another line 21 is connected between the control line 57 and the line 16 of the actuator 11.

In the illustrated position the slider or spool of the valve 3' has its part **3*a'* between the ports so that the back chamber of the valve 53 is connected via the line 55 and through the ports $X_4$ and T to the sump 7. Pressurized fluid from the pump 5 moves via the line 19 and the valve 18 back to the sump 7, maintaining a low operating pressure in the system. Presuming the valve 51 is open, both the actuators 11 and 12 will be connected together via the lines 16, 21, and 57, the valve 51, and the lines 68 and 17, so that as pressure bleeds through the valve 18 it will slowly pressurize the lines 68, 17, and 52 as well as the lines 57 and 21. This will apply equal pressure to the two actuators 11 and 12, although the snap valve 53**, since its back compartment is vented, will open at very low pressure and keep this system pressure down.

Since there is only one spring 13, this action will urge the valve into a position with its part **3*b'* between the ports. As a result full pump pressure will be applied from the port P to the ports A and $X_4$, thereby pressurizing the actuator 1 and the back compartment of the valve 53. This valve 53 will therefore close, allowing the pressure that bleeds through the valve 18 to build up in the conduits 68, 17, 52, 57, 21, and 16, so that the two actuators 11 and 12 will be maintained at a relatively high pressure, locking the valve 3'** in the right-hand position.

If the valve 51 is now closed pressure will bleed out of the conduits 16, 21, and 57 via the bleed hole in the piston of the valve 53 so that the actuator 11 will become relatively depressurized and the valve 3 will shift leftward. As the center position is reached, the valve 53 is depressurized and the actuator 11 will also be depressurized so that the pressure in the actuator 12 will rapidly shove the valve into the right-hand position with the part **3*c'* aligned between the valve ports. In this position the line 60 is pressurized to open the valve 59 and the lines 55 and 2 are connected to the sump 7, thereby keeping the actuator 11 depressurized and retaining the valve in this left-hand position. Opening of the valve 51 will equalize pressure in the actuators 11 and 12** to shift the valve back through the center position into the right-hand position as described above.

Thus a single valve 51 can control a heavy-duty single-acting load, pressurizing and depressurizing it without any use of a secondary control-fluid source. The valve 18 maintains a constant pressure differential between the sides of the valve 3', which differential provides the pressure head necessary to operate the device.

It is also possible as indicated in dot-dash lines in FIG. 4 for a line 26, 61 to connect the conduits 16 and 61, and to provide a restriction 28 in the line 21, a restriction 27 in the line 26, and to use the spring 14. This turns the half-bridge system of the valve 18 and 51 into a full-bridge system.

Figure 5:
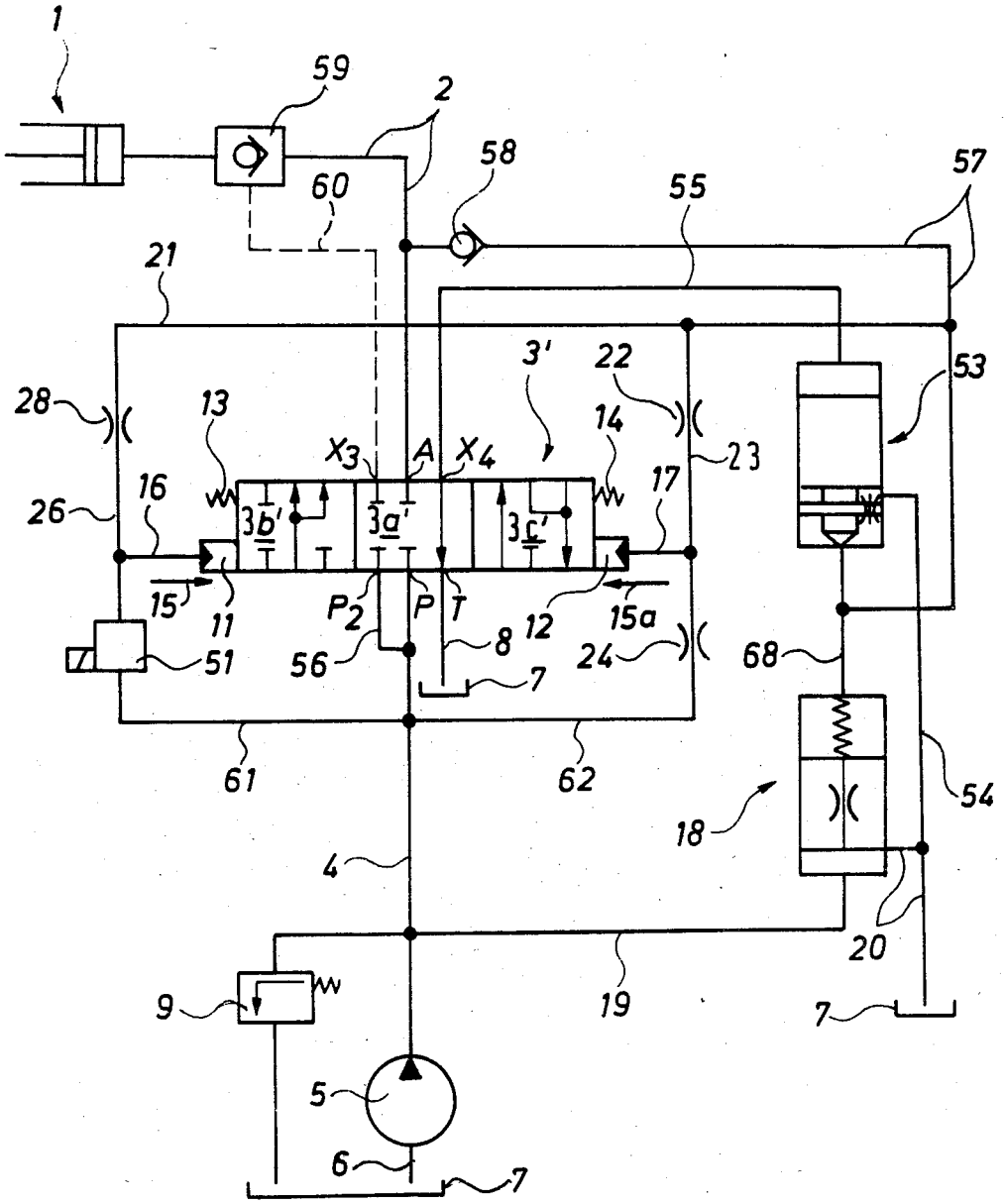
FIGS. 5 and 6 are diagrams of variations on the system of FIG. 4.

FIG. 5 shows another full-bridge system basically the same as the FIG. 4 system and the same reference numerals are used for the same structure. Here, however, the valve 51 is provided in the leg between the actuator 11 and the high-pressure line 4. The adjacent leg is formed by a line 62 provided with a variable but normally fixed restriction 24 connected between the line 4 and the actuator 12. Two further restrictions 22 and 28 are connected between the actuators 12 and 11, respectively, and the control line 57. Both springs 13 and 14 are used. Closing the valve 51 pushes the valve 3' to the left, and opening it pushes it to the right. Operation is the same as in FIG. 4. In the illustrated central position of the valve 3' the hydraulic bridge of the instant invention is in mechanical and hydraulic balance. The position of the valve 51 can be changed by varying any of the restrictions 22, 24, or 28.

Figure 6:
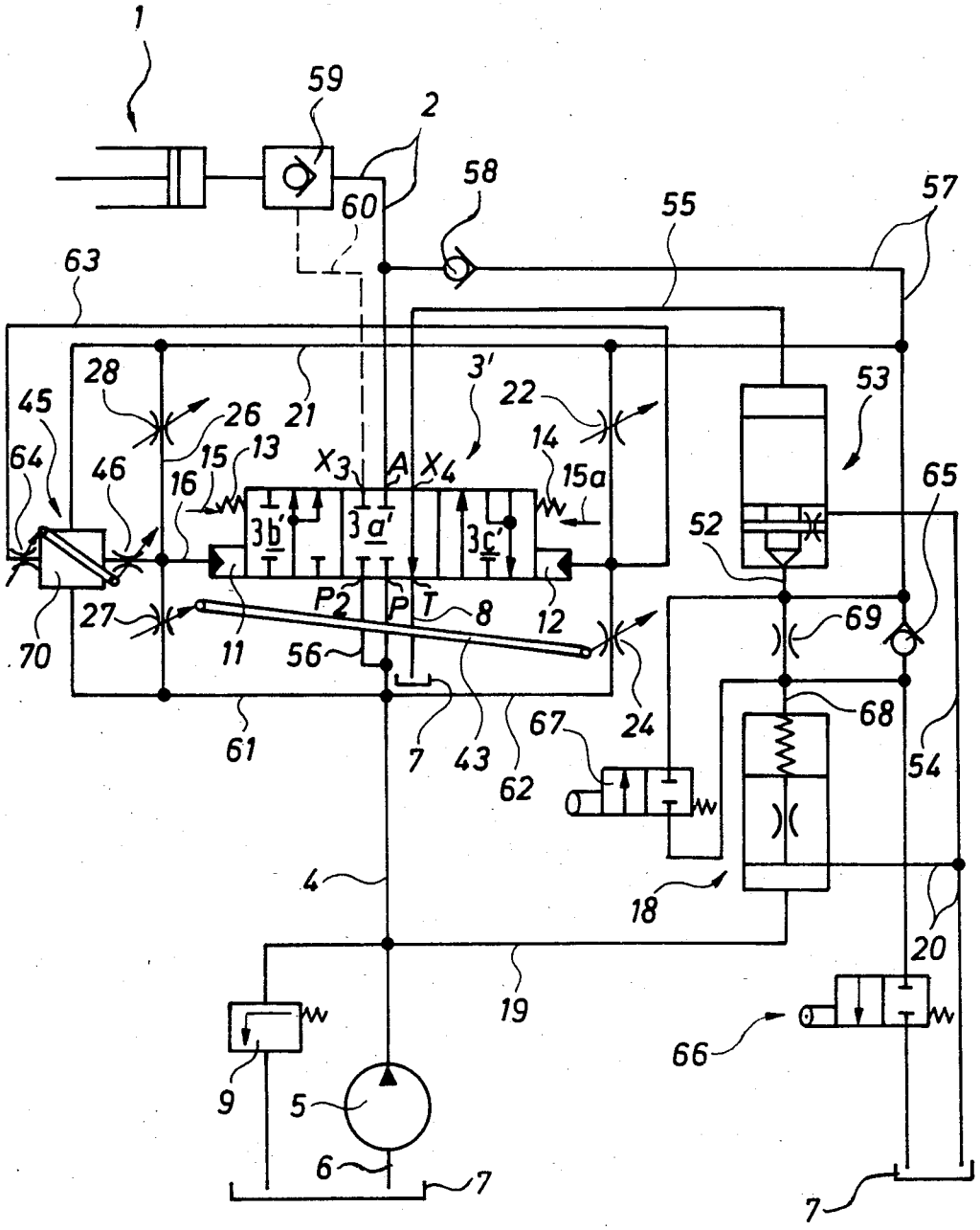

In FIG. 6 the same reference numerals as in FIG. 5 are used for the same structure. Here, however, the restrictions 24 and 27 are adjustable and are interconnected by an element 43 so that as the flow cross section of the one is increased that of the other is decreased and vice versa. A restriction 69 shunted by a check valve 65 and a solenoid-operated flow-control valve 67 is provided in the line 68, 52, and another such shutoff valve 66 is provided between the line 68 and the sump 7. An adjustable restriction 46 connects the line 16 between the restrictions 27 and 28 to a pressure-ratio valve 45 connected between the control line 57 and the high-pressure line 4, and another such restriction 64 also connects this valve 45 to the line 17 between the restrictions 22 and 24. An element 70 interconnects these restrictions 46 and 64 and is operated by the pressure differential across the valve 45 to vary them oppositely. If the ram 1' is in one of its end positions it acts on the respective valve 66 or 67 to lower pressure, to which end such a valve is set up like a limit switch.

The pressure head necessary to operate the actuators 11 and 12 is, once again, taken off the pressure compensator 18. Actuation of an appropriate fast-action switch such as the one seen at 38 in German utility model No. 3,106,086.2 eliminates the control and puts the load in one of its end positions. When one of the valves 66 or 67 is open and the control pressure drops, the remaining pressure in the system is sufficient to open the valve 59.

In the arrangement of FIG. 6 the restrictions 22 and 28 are set with desired values for example for the traction force of a tractor and for the holding force for a plow carried thereby. The restrictions 22 and 28 therefore form actual values with which the desired values can be compared. The pressure-ratio valve 45 can use other values for depending on the position of the restrictions 46 and 64.

I claim:

1. A hydraulic system for operating a pressurizable load off a pressure source having a high-pressure side and a low-pressure side, the system comprising:

a main valve having a load side connected to the load and a source side connected to both sides of the source and displaceable between one position permitting flow from the source to the load and another position for opposite flow;

respective fluid-operated actuators for displacing the valve into its positions;

control means having an input side connected to the high-pressure sides of the source at the source side of the valve and an output side connected to the load at the load-side of the valve and with the sump at the source side of the valve, the control means also being connected to the actuators for pressurizing same alternately and thereby moving the valve between its positions; and pressurizing means connected at least to the source side of the pump and to both sides of the valve and of the control means for maintaining a generally constant pressure drop across the valve and the control means.

2. The hydraulic system defined in claim 1 wherein the pressurizing means includes a differential-pressure regulator connected across the sides of the valve and to the sump.

3. The hydraulic system defined in claim 2 wherein the regulator is a differential valve that blocks flow from the high-pressure side of the source to the valve when pressure at the load side of the valve is higher than a predetermined level below the pressure at the high-pressure side of the source.

4. The hydraulic system defined in claim 2 wherein the regulator is a differential valve that bleeds pressure from the high-pressure side to the low-pressure side when pressure at the load side of the valve is higher than a predetermined level below the pressure at the high-pressure side of the source.

5. The hydraulic system defined in claim 4 wherein the pressurizing means includes a snap valve connected on one side to the regulator and on its other side to the load side of the main valve and connectable therethrough to the high- and low-pressure sides of the source.

6. The hydraulic system defined in claim 1, further comprising a flow-control valve connected between the actuators for blocking flow therebetween when closed and permitting flow therebetween when open.

7. The hydraulic system defined in claim 1 wherein one of the actuators is permanently connected through the control means with the high-pressure side of the source and the control means is connected between this one actuator and the pressurizing means.

8. The hydraulic system defined in claim 1, further comprising a shutoff valve between the output side of the pressurizing means and the sump and openable to interconnect same.

9. The hydraulic system defined in claim 1, further comprising a restriction between the pressurizing means and the sump and a shutoff valve connected across the restriction and openable to bypass same.

10. A hydraulic system for operating a pressurizable load off a pressure source having a high-pressure side and a low-pressure side, the system comprising:

a main valve having a load side connected to the load and a source side connected to both sides of the source and displaceable between one position permitting flow from the source to the load and another position for opposite flow;

respective fluid-operated actuators for displacing the valve into its positions;

pressurizing means connected across the main valve and across the sides of the source for maintaining a generally constant pressure drop across the main valve; and control means connected across the valve and to the actuators for pressurizing same alternately and thereby moving the valve between its positions.

11. The hydraulic system defined in claim 10 wherein the control means includes a first restriction connected between the source side of the valve and one of the actuators and a second restriction connected between the source side of the valve and the other actuator, at least one of the restrictions being variable relative to the other, whereby the restrictions form a half bridge.

12. The hydraulic system defined in claim 11 further comprising a third restriction connected between the load side of the valve and the one actuator and a fourth restriction connected between the load side of the valve and the other actuator, whereby the restrictions form a full bridge.

* * * * *